United States Patent [19]

DiNallo, Sr. et al.

[11] 4,361,112

[45] * Nov. 30, 1982

[54] APPARATUS FOR DEVELOPING LATENT ELECTROSTATIC IMAGES

[75] Inventors: Samuel R. DiNallo, Sr., Framingham; Leon K. Najarian, Milford, both of Mass.

[73] Assignee: Coulter Systems Corporation, Bedford, Mass.

[ * ] Notice: The portion of the term of this patent subsequent to Jun. 9, 1998, has been disclaimed.

[21] Appl. No.: 228,251

[22] Filed: Jan. 26, 1981

Related U.S. Application Data

[63] Continuation of Ser. No. 134,519, Mar. 27, 1980, Pat. No. 4,271,785.

[51] Int. Cl.[3] ..... G03G 15/10

[52] U.S. Cl. ..... 118/661; 355/10

[58] Field of Search ..... 118/661; 355/10; 354/318; 430/119

[56] References Cited

U.S. PATENT DOCUMENTS

| | | | |
|---|---|---|---|
| 3,800,743 | 4/1974 | Egnaczak | 118/661 X |
| 4,017,174 | 4/1977 | Cheeseman | 355/10 |
| 4,023,899 | 5/1977 | Hayashi et al. | 355/10 |
| 4,271,785 | 6/1981 | DiNallo, Sr. et al. | 118/661 |

*Primary Examiner*—Evan K. Lawrence

*Attorney, Agent, or Firm*—Silverman, Cass & Singer, Ltd.

[57] ABSTRACT

A removable cartridge like toning device for electrophotographic imaging apparatus of the type wherein a latent electrostatic image formed on an endless electrophotographic belt is translated past a toning station for rendering the latent image visible. The toning device described is a box-like container for liquid toner having an elongate longitudinal slot formed in the top wall and a feed roller seated for rotation within said container, a portion of the circumferential outer surface of the roller extending from the slot. The side walls of the container are provided with inclined flanges cooperating with conformingly inclined ramps provided in the imaging apparatus at the toning station so that the container is guided to a position closely spaced substantially parallel to the electrophotographic belt. Ring collars are arranged at opposite ends of the roller for free rotation relative thereto, the collars having a slightly greater diameter than that of the roller to define a uniform gap between the roller and the electrophotographic belt when the cartridge is installed. One end of the container carries structure to establish electrical contact with the imaging apparatus while the other opposite end carries a grommet/plunger device cooperable with an upright apertured bracket for locking the container in place once proper orientation is achieved. Installation is effected by sliding the container along the ramps, with operation of the grommet/plunger device bringing the roller into parallel relationship with the electrophotographic belt.

4 Claims, 5 Drawing Figures

APPARATUS FOR DEVELOPING LATENT ELECTROSTATIC IMAGES

This is a continuation of application Ser. No. 134,519 filed Mar. 27, 1980, U.S. Pat. No. 4,271,785.

BACKGROUND OF THE INVENTION

This invention relates generally to the development of latent electrostatic images and more particularly relates to the provision of a self-contained cartridge for storing and applying liquid toner to the image bearing surface of an electrophotographic belt as said surface moves therepast.

The formation of an image on the surface of a photoconductive member by electrophotographic means is well known in the art.

Basically, the technique involves placing a uniform electrostatic charge on the surface, exposing the charged surface to a pattern of light so as to form thereon a latent electrostatic image and then developing the latent electrostatic image by depositing on the surface, finely divided electroscopic material referred to in the art as "toner". The toner is attracted to those areas of the surface retaining the electrostatic charge, thereby forming a toned image. The toned image may either be fixed to the surface of the photoconductive member by heat lamps or other suitable means or transferred to a secondary support surface such as paper and then fixed if desired or necessary.

In some known electrophotographic copying or duplicating machines the photoconductive member is in the form of a drum which rotates in unison relative to a plurality of processing stations. For high speed copying, however, it has been found necessary that the photoconductive surface be in a flattened condition at the time of exposure in order to insure complete focusing of the original being copied. Consequently, it has been found advantageous to employ a photoconductive member in the form of an endless belt or web mounted for rotational movement across at least two rollers.

Regardless of whether the photoconductive member is in the form of a drum or a belt mounted on rollers, the latent electrostatic image so formed can be developed into a visible image by using any one of several known techniques; these include cascade development, magnet brush development and liquid development. In liquid development a dispersion of electroscopic particles in an insulating liquid is employed and the electrostatic image developed by deposition of particles from the liquid to the photoconductive surface. In such development, the liquid containing the particles contacts the photoconductive surface in both the charged and uncharged areas. Under the influence of the electric field associated with the charged image pattern, the suspended particles migrate toward the charged portions of the surface separating out of the insulating liquid. The electrophoretic migration of charged particles results in the deposition of charged particles on the imaging surface in an image configuration. Such development has been obtained in the past by flowing the liquid developer over the image bearing surface, by immersing the image bearing surface in a bath of the developer liquid and by presenting the developer liquid on a smooth surfaced roller and moving the roller against the imaging surface. In connection with these various techniques, it is known that the development can be improved, especially if the image contains large solid areas, through the use of what is known in the art as a development electrode.

In U.S. Pat. No. 4,025,339 issued on May 24, 1977 to M. R. Kuehnle there is described an electrophotographic film that is capable of being imaged with quality and gray scale, as good as, if not better than, that achieved by photographic techniques. The film comprises an inorganic coating of microcrystalline material that is bonded onto a conductive substrate. The inorganic coating may comprise a layer of about 2,000 Angstroms to 2 microns thick of radio frequency sputtered cadmium sulfide. The conductive substrate may comprise a layer of about 500 Angstroms thick of indium tin oxide on a sheet of stable polyester plastic about 5 microns thick. A latent electrostatic image formed on the film may be developed using a liquid toner.

In order to make the fullest use of the exceptional properties of the electrophotographic film described in the above noted patent, especially for high speed duplicating or copying machine applications, there is a need for a simple yet efficient technique for developing a latent electrostatic image formed thereon using a liquid toner.

One device developed for use with an electrophotographic imaging apparatus employs a container having therein a quantity of liquid toner. The container includes an arcuate shaped top wall defining a recess. The said wall includes a conductive surface so as to function as a development electrode and also is provided with a centrally located longitudinal slot in the recess. The recess is concentric with the adjacent roller on which the electrophotographic belt is mounted. In use the container is positioned so that in a well or on a similar support so that that the top wall, i.e. arcuate path taken by the belt thereat when mounted on the said rollers. Liquid toner is brought up from the container to the vicinity of said belt by means of a motor driven feed roller which is suitably positioned within the container.

The suggested device required precision slide or well means to be constructed and positioned within the electrophotographic apparatus so that a uniform gap between the top wall of the container and the electrophotographic belt could be established. Ease of fabrication was desired but not fully achieved. The precision required resulted in considerable rise in cost of fabrication. Removability was adequate but could be improved. Positioning of the container also could be improved, that is assuring uniformity of the gap, i.e. and proper spacing of the belt and development electrode.

Often an electrical bias was applied to the gap during toning. Some difficulties were encountered in establishing electrical contact.

Ease in installation of the container also could be improved, such as provision of improved means for retaining the container in place. Some difficulties could be encountered in "creep" or "run-up" of liquid suspending agent and toner suspension, i.e. by the activity of the roller. In the previously mentioned device, creep of the liquid (insulating) suspending agent along the development electrode not only could result in spillage in the machine but could interfere with the development electrode, i.e. uniformity of bias field, etc., and some could migrate along the belt to interfere with the image plane at the exposure station.

SUMMARY OF THE INVENTION

Accordingly there is provided a self-contained toning cartridge for an electrophotographic imaging apparatus wherein an electrophotographic member carrying a latent electrostatic image is translated therepast for development of said image. The cartridge comprises a container for liquid toner which has opposite side and end walls, a bottom wall and a slotted top wall. A feed roller is sealably journalled at opposite ends of the container for rotation therein, the outer circumferential surface of the roller extending through the slotted top wall. Cooperative flange and ramp means are provided on the side walls of the container and the imaging apparatus for seating the cartridge therewithin. Collar means are mounted to opposite ends of the roller, the collar means having a greater diameter than the roller, whereby to ride the electrophotographic belt so as to space the roller surface from the belt defining a predetermined uniform gap therebetween, the belt not touching the roller. Means are provided at one end of the container releasably to lock the container in place and also to lift the container to establish a true parallel relationship between the roller and the surface of the electrophotographic member and means are provided to effect an electrical engagement when the cartridge and the roller thereof are fully installed within said imaging apparatus.

DESCRIPTION OF THE PREFERRED EMBODIMENT

Figure 1:
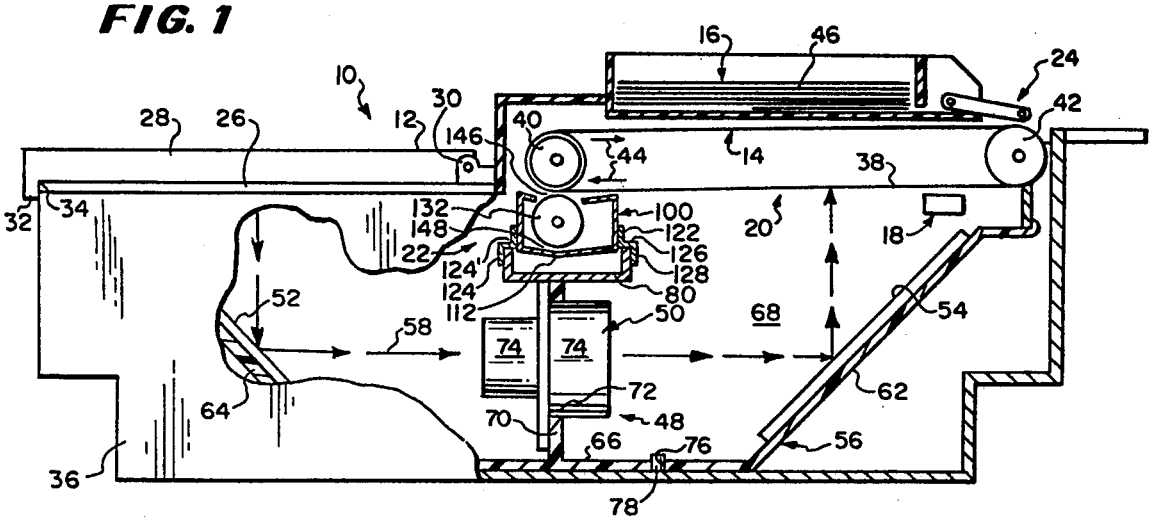
FIG. 1 is a sectional diagrammatic sectional representation of an electrophotographic imaging apparatus having the toning device of the invention installed therein.

Referring to the drawings, in FIG. 1 there is illustrated an electrophotographic copying machine designated generally by reference character 10 and including a document mounting platen assembly 12, an electrophotographic imaging assembly 14, including transfer medium supply station 16, a charging station 18, an exposure station 20, a toning or development station 22, and a transfer station 24.

The document mounting platen assembly 12 includes a transparent planar member 26 suitably seated and a suitable platen cover 28 mounted for pivotal movement on brackets 30 whereby to sandwich a master document between the member 26 and cover 28. Suitable catch means 32 are provided along the free edge of the platen cover 28 to engage the corner 34 of the housing 36.

The electrophotographic imaging assembly includes an electrophotographic belt 38 mounted for rotational movement on a pair of rollers 40 and 42, roller 40 driven and coupled to a drive motor (not shown). The belt 38 is arranged to rotate in the direction shown by arrows 44 sequentially past the series of the work stations, 18, 20, 22 and 24.

As used throughout the specification and claims hereof, the term "electrophotographic belt" is used to describe an endless belt or web of which at least a portion is electrophotographic in character, that is, made up of a portion having a photoconductive coating on a conductive substrate.

The belt 38 first is directed to charging station 18 where the photoconductive coating surface coating of the belt is charged uniformly. The belt 38 next is directed to the exposure station 20 where the charged surface is exposed to a light image of the master document to form thereon a latent electrostatic image. The belt 38, carrying the latent image, next is directed to the development or toning station 22 where the latent electrostatic image is developed. The belt 38 then travels to the transfer station 24 where the toned image is transferred to a sheet of paper 46 or other material from the supply station 16.

The exposure station 20 is located along the upper planar reach belt 38, the rollers 40 and 42 being positioned so that the upper reach thereof is in a plane generally parallel to the top surface of copy platen 26 on which the master document is placed. The belt 38 carries a photoconductive coating bonded to the outer surface thereof and, when operatively installed, the photoconductive coating faces downward at the exposure station 20.

The light image is of the master document projected from the copy platen 20 onto the photoconductive coating of the belt at the exposure station 20 by means of optical projection system 48.

The optical projection system 48 includes in optical alignment, a lens system 50 and a pair of 45° planar mirrors 52 and 54. The lens system 48 is positioned mid-way between said planar mirrors 52 and 54. The mirrors may vary slightly from 45° orientation. Lens system 50 and said planar mirrors 52,54 are mounted on a basket-like, open topped mounting or support 56 seated within the machine housing 36 at a location such that the image of the master document is projected to the belt 38 along the path indicated by arrows 58.

The mounting 56 which is shown in FIG. 1, is a basket-like rigid member preferably molded as an integral member out of plastics material. The mounting 56 includes a bottom wall or floor 60 and a pair of outwardly inclined planar end walls 62 and 64 at opposite ends of the floor 66. Connecting walls 68 bridge the end walls 62 and 64, and an upright partition 70 extends vertically from said floor 66. End walls 62 and 64 are inclined in opposite directions at an angle generally of 45° relative floor 66 and seat mirrors 52,54. Partition 70 is located midway between end walls 62 and 64. The lens system 50 is mounted on the partition 70 through an opening 72 and rigidly is fixed thereat by any suitable means (not shown). The lens system 50 may be encased in a flanged cylindrical housing 74 and the dimension of opening 72 enables a frictional engagement to be established with the cylindrical housing 74.

Floor 66 may include a plurality of mounting apertures 76 cooperative with studs 78 provided on the floor of the housing 36 to effect a snap-in connection therewith.

Figure 4:
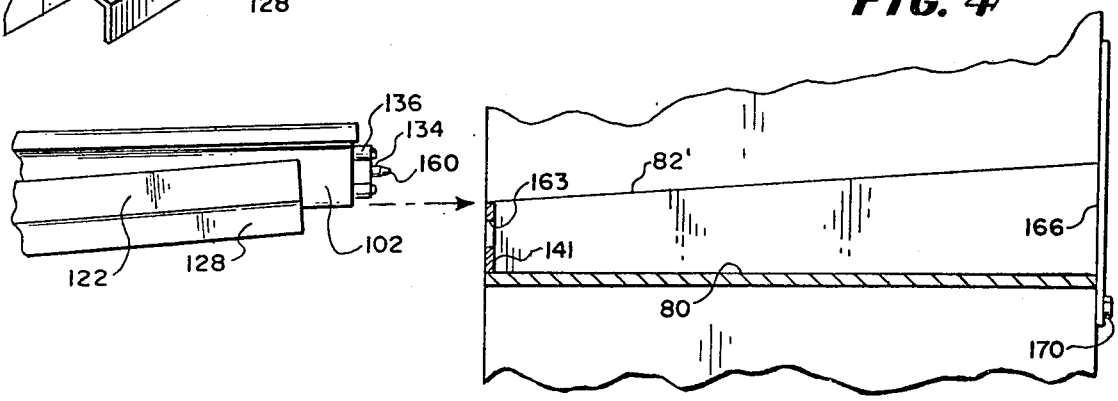
FIG. 4 is a fragmentary section further illustrating the assembly process of FIG. 3.
Figure 5:
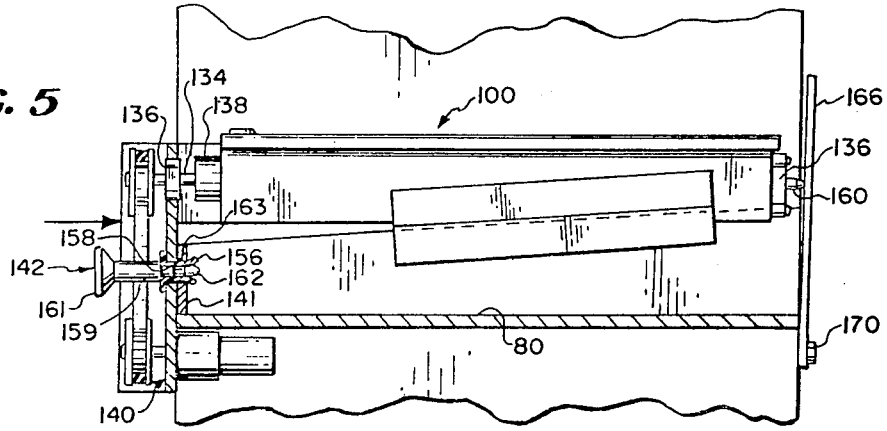
FIG. 5 is a sectional view illustrating the installed condition of the cartridge according to the invention.

The height of the partition 70 is selected to be less than the overall height of the basket-like support 56 so that a flanged beam 80, provided as a part of the electrophotographic imaging assembly framework for supporting a toner containing cartridge 100 may rest upon the upper edge of the partition 70. The flanges 124,126 carried by cartridge 100 function as runners cooperating with the canted flanges of beam 80 which define upwardly inclined ramps 82',84' (FIGS. 4,5).

Figure 2:
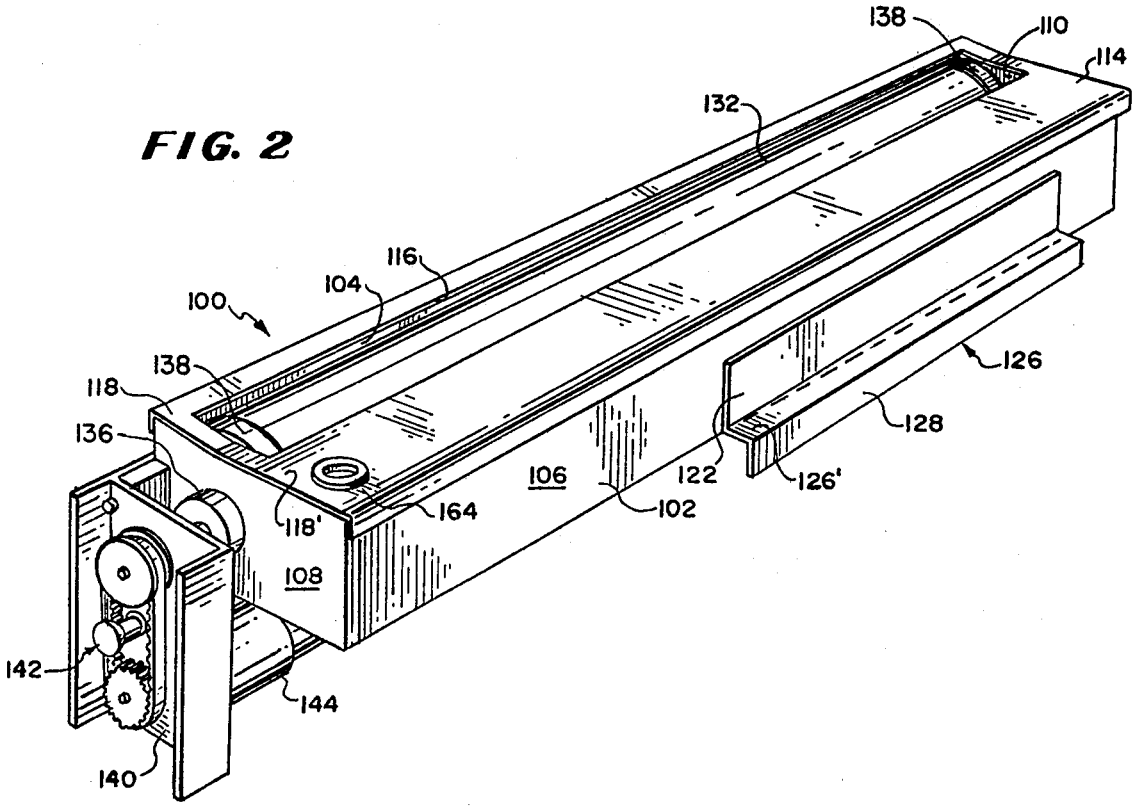
FIG. 2 is a perspective view of the self-contained toner cartridge provided by the invention.

The invention herein relates particularly to the toning station 22 and referring to FIG. 2, to the toner cartridge 100 and comprises a container 102 of generally box-like configuration having opposite side walls 104 and 106, opposite end walls 108 and 110, a bottom wall 112 and a top wall 114. The top wall 114 includes an elongate longitudinal slot 116 along substantially the entire length thereof. Canted linear portions 118,118' of the top wall 114 border the slot 116. Side walls 104 and 106 carry the runners 124,126 comprising flanged angle strips 120,122 secured along their length, horizontal portions 124' and 126' thereof extending coplanar and outwardly from each respective side wall and offset depending portions 128 which function as stabilizer guards as will be explained later herein. The runners 124,126 extend outward from the side walls 104,106 with portions 124',126' horizontally disposed at a slight acute angle, here 1°, from one end to the other thereof.

A cylindrical feed roller 132 carried by the shaft 134 is journalled in suitable sealed bearings 136 mounted in the end walls 108,110 of the container 102. The opposite ends of the shaft 134 extend outward of the end walls 108,110 of the container 102. A ring spacer or collar 138 is mounted on the shaft 134 adjacent each end of the roller 132 and arranged adjacent to said roller ends whereby when the roller 132 is installed in the container 100, the collar or spacers are positioned between the roller and the inner surface 108', 110' or the end walls 108 and 110 respectively. The edges of beam flanges 82,84 are likewise inclined along their length at a 1° rise and each have planar top surfaces 82',84' cooperating with the portions 124',126' of runners 124,126 of container 102 with portions 128 of said runners 124,126 adjacent respective flanges 82,84.

A flanged bracket 140 is mounted to the end wall 108 of the container 102 and carries an aperture 142 for receiving one shaft end therethrough. The bracket 140 also carries a grommet/plunger device 142 for locking the container 102 in installed condition within the imaging apparatus 10. A drive motor 144 also is carried by said bracket 140 and extends below the container 102. Suitable gear and pulley means are provided to drive the feed roller 132.

The collars or spacer rings 138 preferably are mounted on shaft 134 for free rotation relative to the shaft and feed roller 132. The collars 138 are formed of plastic material preferably of Delrin TM plastic. The collars 138 are identical and have a precise diameter slightly greater than the diameter of the feed roller 132. In fact, it is intended that only the outer circumferential surface of the collars 138 will engage the electrophotographic belt. The collar 138 functions to space the roller 132 from the belt 38 to define a predetermined precise gap 146 therebetween. The collars 138 are positioned to engage the belt 38 just inboard of the belt edges outside of the image area thereof.

The slot 116 formed in the top wall 114 of the container 102 is disposed closer to one side wall 105 of the container 102 than wall 106. Likewise, the bottom wall 112 is provided with a recess 148 coincident with the center line of the slot 116, and with the axis of the feed roller 132 when same is installed in the container 102. The diameter of the roller 132 and the height of the container is selected so that the roller 132 is only slightly spaced from the bottom wall 112 and within the recess 148. The canted portions 118 and 118' which define the slot 116 can be beveled and are closely spaced but not touching the surface of the roller 132. The cant of portion 118' is about 2°, the same as the lower reach of belt 38. The portion 118' serves to prevent back splash or liquid creep which might be encountered.

It is essential that cartridge 100, when installed, the gap between the feed roller 132 and the electrophotographic belt 38 is uniform along its extent. Accordingly, the flange portions 124',126' of runners 124,126 and the ramps 82',84' are canted, i.e. inclined upwardly 1° with the portion thereof which is closely adjacent end wall 110 defining the minimum desired distance needed to establish gap 146. A grommet/plunger device 142 is mounted on bracket 140 comprising an expandable grommet 156 formed of plastic material and having a bore 158 through which the plunger 159 extends. Plunger 159 has an enlarged head portion 161 for grasping same. The free end 162 of said plunger 159 also may be slightly enlarged. When the plunger 159 is forced through the grommet 156, the grommet is expanded. The container 102 is slidably transported at toner station 22 with the runners 124,126 slidably engaged along ramps 82',84'. When the container has been fully inserted, the grommet 156 passes fully through the aperture 163 formed in bracket 140 which is mounted on beam 80 in intercepting condition in the path of said cartridge 100. The plunger 159 is forced into the grommet expanding the same. Expansion of the grommet 156 not only locks the cartridge 100 in the apparatus 10 but forces a portion of the grommet to bear against the exterior surface of the bottom wall 112 of container 102, lifting the container 102 the 1° to assure that the surface of the roller 132 is parallel to the electrophotographic belt 38 and spaced the same distance from said belt 38 along its length and at opposite ends thereof.

One of the runners 124,126 can be formed shorter than the other. In this instance, the container 102 can be withdrawn from its installed condition. At a certain extent of the withdrawal, the edge of the strip will engage the frame of the imaging apparatus 20 at the toning station 22 and serve as a stop. The container 102 once installed can be partially withdrawn for filling with liquid toner through the covered port 164 formed in the top wall 114 adjacent a corner thereof, as shown in FIG. 2.

Figure 3:
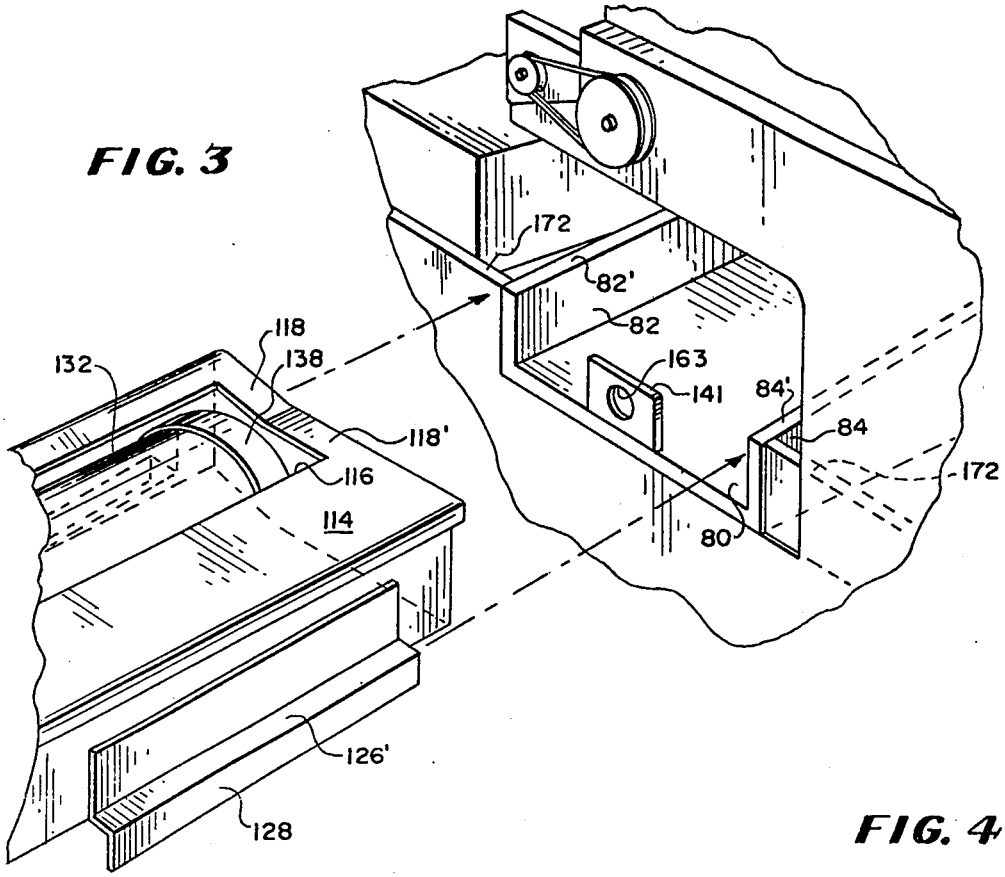
FIG. 3 is a fragmentary perspective view illustrating the assembly of the cartridge of FIG. 2 into the imaging apparatus of FIG. 1.

Alternatively, the height of beams 82,84 can be selected such that the ramps 82',84' thereof are generally flush with the upper edge of the frame of the imaging apparatus 10 shown at 172 in FIG. 3. Accordingly, the length of the runners 124,126 is selected so that, once installed in support 56, the container can be withdrawn to the extent that the runners 124,126 engage the frame 172.

The end 160 of shaft 134 extends through sealed bearing 136 of wall 110 to extend outward of the container 102. Either the shaft end per se, or a conductive cap placed over end 160 engages upright spring contact 166 mounted on the frame of the imaging apparatus as by screws 170 for the purpose of establishing electrical contact to enable an alectrical bias to be established across the gap 146 if desired.

As viewed in the FIGS. (2 to 4) the cant or inclination of ramps 82',84' and runners 124 and 126 are exaggerated to facilitate viewing and understanding.

We claim:

1. A toning device for disposition at the toning station of an electrophotographic imaging apparatus wherein an electrophotographic member having a photoconductive coating portion on one surface thereof which carries a latent electrostatic image is translated therepast for development of said image, said toning device comprising a container of generally rectangular box-like configuration adapted to contain a liquid toner suspension therein, said container having opposite side walls, opposite end walls and a bottom wall, liquid toner feed roller means within said container lengthwise thereof and extending partially outward thereof, said liquid toner feed roller means being journalled for rotation at the opposite end walls for rotating said liquid toner feed roller means in contact with the toner suspension, collar means coaxially coupled to said feed roller means interior of said container and adjacent the end walls of said container at opposite ends of said liquid toner feed roller means for free rotation independent of said liquid toner feed roller means, said collar means having an outer diameter slightly greater than the diameter of said liquid toner feed roller means and means for seating said container within said electrophotographic imaging apparatus at the toning station thereof with said liquid toner feed roller means closely proximate said photoconductive surface of the electrophotographic member parallel thereto and said collar means engaged therewith along the edges thereof whereby to define a toning gap therewith for receiving toner suspension from said liquid toner feed roller means.

2. The structure as claimed in claim 1 and means at one end of said liquid toner feed roller means for establishing an electrical connection between said liquid toner feed roller means and exterior electrical contact means to enable an electrical bias to be applied between said liquid toner feed roller means and said electrophotographic member.

3. The structure as defined in claim 1 in which there are support means for said container disposed within said electrophotographic apparatus at the toning station thereof and said seating means comprising slide means on said support means.

4. A self-contained cartridge for liquid toner for use in developing a latent image electrostatic image formed on the image bearing surface of an electrophotographic belt within an electrophotographic imaging apparatus as the surface is moving therepast, said cartridge comprising a container for holding a quantity of liquid toner, said container having bottom and opposite side and end walls, and a liquid toner feed roller sealably journalled in said end walls for rotation within said container in contact with the liquid toner, said liquid toner feed roller sized and positioned to extend partially outward of said container, said liquid toner feed roller carrying a freely rotatable end washer at each end thereof, each washer having a slightly larger outer diameter than said liquid toner feed roller for supporting said liquid toner feed roller on said belt surface to define a gap between said liquid toner feed roller and belt of predetermined dimension.

* * * * *